US010021498B2

(12) United States Patent
Kaminski et al.

(10) Patent No.: US 10,021,498 B2
(45) Date of Patent: Jul. 10, 2018

(54) METHOD OF MANUFACTURING ASSEMBLIES FOR HEARING AIDS

(71) Applicant: Sonion A/S, Roskilde (DK)

(72) Inventors: Robert Kaminski, Szczecin (PL); Piotr Dabrowski, Szczecin (PL); Malgorzata Paruszewska, Warzymice (PL); Jan Hijman, De Bilt (NL); Konrad van den Berg, Zoetermeer (NL)

(73) Assignee: Sonion A/S, Roskilde (DK)

( * ) Notice: Subject to any disclaimer, the term of this patent is extended or adjusted under 35 U.S.C. 154(b) by 137 days.

(21) Appl. No.: 14/625,283

(22) Filed: Feb. 18, 2015

(65) Prior Publication Data

US 2015/0237453 A1 Aug. 20, 2015

(30) Foreign Application Priority Data

Feb. 18, 2014 (EP) ..... 14155538

(51) Int. Cl.
*H04R 31/00* (2006.01)
*H04R 25/00* (2006.01)

(52) U.S. Cl.
CPC ..... *H04R 31/00* (2013.01); *H04R 25/00* (2013.01); *H04R 2225/021* (2013.01); *Y10T 29/49005* (2015.01)

(58) Field of Classification Search
CPC .. H04R 2225/021; H04R 25/60; H04R 31/00; Y10T 29/49005
See application file for complete search history.

(56) References Cited

U.S. PATENT DOCUMENTS

| | | | | |
|---|---|---|---|---|
| D231,991 | S * | 7/1974 | Harada | D13/146 |
| 6,788,796 | B1 | 9/2004 | Miles et al. | |
| 6,831,577 | B1 | 12/2004 | Furst | |
| D501,255 | S * | 1/2005 | Feeley | D24/174 |
| 6,853,290 | B2 | 2/2005 | Jorgensen et al. | |
| 6,859,542 | B2 | 2/2005 | Johannsen et al. | |

(Continued)

FOREIGN PATENT DOCUMENTS

| | | |
|---|---|---|
| EP | 1808286 A1 | 7/2007 |
| WO | WO 2006/056198 A2 | 6/2006 |

OTHER PUBLICATIONS

Extended European Search Report corresponding to co-pending European Patent Application Serial No. EP 14155538.3, European Patent Office, dated Jun. 20, 2014; (3 pages).

*Primary Examiner* — Minh Trinh
(74) *Attorney, Agent, or Firm* — Nixon Peabody LLP

(57) ABSTRACT

The present invention provides a method of manufacturing a receiver-in-canal assembly. The method comprises the steps of providing a receiver housing configured to be positioned in or at the ear canal of a user, and further being configured to comprise a receiver configured to output sound; providing a connector housing configured to be connected to a behind-the-ear part of a hearing aid; and providing an elongated tube configured for transfer of a signal from the connector housing to the receiver housing. In a further step the receiver housing and the connector housing are attached to opposite ends of the elongated tube. Subsequently, the tube is permanently deformed after attachment of the receiver housing and the connector housing to the tube by exposing it to heat in a first predetermined treatment period.

26 Claims, 5 Drawing Sheets

(56) References Cited

U.S. PATENT DOCUMENTS 6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,027,608 B2 * 4/2006 Fretz ..... H04R 25/65 381/322
7,062,058 B2 6/2006 Steeman et al.
7,062,063 B2 6/2006 Hansen et al.
7,072,482 B2 7/2006 Van Doom et al.
7,088,839 B2 8/2006 Geschiere et al.
7,110,560 B2 9/2006 Stenberg
7,110,562 B1 * 9/2006 Feeley ..... H04R 25/60 381/322
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Halteren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,442,253 B2 * 5/2013 Finlay ..... H04R 25/608 381/322
8,509,468 B2 8/2013 van Halteren et al.
8,526,651 B2 9/2013 Lafort et al.
8,526,652 B2 9/2013 Ambrose et al.
2009/0121386 A1 * 5/2009 Ipsen ..... B29C 53/84 264/263
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2015/0237453 A1 * 8/2015 Kaminski ..... H04R 31/00 29/594

* cited by examiner

METHOD OF MANUFACTURING ASSEMBLIES FOR HEARING AIDS

CROSS-REFERENCE TO RELATED APPLICATION

This application claims the benefit of European Patent Application Serial No. EP14155538.3, filed Feb. 18, 2014, and titled "A Method Of Manufacturing Assemblies For Hearing Aids," which is incorporated herein by reference in its entirety.

FIELD OF THE INVENTION

The present invention relates to an improved method of manufacturing receiver-in-canal assemblies for hearing aids. The receiver-in-canal assembly comprises a receiver housing configured to be positioned in or at the ear canal of a user, and further being configured to comprise a receiver configured to output sound. The assembly further comprises a connector housing configured to be connected to a behind-the-ear part of a hearing aid, and an elongated tube configured for transfer of a signal from the connector housing to the receiver housing.

BACKGROUND OF THE INVENTION

Manufacturing of receiver-in-canal assemblies for hearing aids comprises a step of assembling a receiver housing and a connector housing with an elongated tube configured for transfer of a signal from the connector housing to the receiver housing. The receiver housing is configured to be positioned in or at the ear canal of a user, and is further configured to comprise a receiver which is configured to output sound. The connector housing is configured to be connected to a behind-the-ear part of a hearing aid.

To facilitate positioning of the receiver housing in or at the ear canal and to facilitate positioning of the connector housing on or behind the ear of a user, the elongated tube has to be bent, and in order to ensure that the hearing aid is kept in place it may be an advantage, that the tube is permanently bended, and thus permanently deformed. One way to achieve this is to heat the tube. As both the receiver housing and the connector housing may comprise heat sensitive components, permanent deformation of the elongated tube is traditionally carried out as one of the first steps in the manufacturing process. Subsequently, the receiver housing and the connector housing can be attached to opposite ends of the bended tube.

Assembling of hearing aids comprising a bended tube may result in a high reject rate, as process steps including gluing, soldering, and the like, are difficult and associated with a high error rate due to the very small size of the different elements. This is further hampered by fixtures required to keep the bended tube in a fixed position during assembly as these limit the freedom of handling. One of the problems is that the bended tube, despite the permanent deformation is re-straightened or at least un-bended to a certain degree. Furthermore, the receiver housing and/or the connector housing may be attached at an angle which differs from the required angle. Finally, the assembly process is time consuming.

DESCRIPTION OF THE INVENTION

It is an object of embodiment of the invention to provide an improved method of manufacturing hearing aids.

It is a further object of embodiments of the invention to provide a method which reduces the time consumption associated with manufacturing of hearing aids.

It is an even further object of embodiments of the invention to provide a method which reduces the number of receiver-in-canal assemblies to be rejected during or after the manufacturing process.

According to a first aspect, the invention provides a method of manufacturing a receiver-in-canal assembly, the method comprising the steps of:

- providing a receiver housing configured to be positioned in or at the ear canal of a user, and further being configured to comprise a receiver to output sound;
- providing a connector housing configured to be connected to a behind-the-ear part of a hearing aid;
- providing an elongated tube configured for transfer of a signal from the connector housing to the receiver housing;
- attaching the receiver housing and the connector housing to opposite ends of the elongated tube; and
- permanently deforming the tube after attachment of the receiver housing and the connector housing to the tube by exposing it to heat in a first predetermined treatment period t1.

The receiver housing and the connector housing are attached to the tube prior to the deformation. In this unbended state of the tube, positioning of the receiver housing relative to the connector housing may be performed very precise.

Since the tube is deformed after attachment of the receiver housing and the connector housing, the deformation process is based on a final relative orientation of the tube, the receiver housing, and the connector housing. Accordingly, a more precise tube shape relative to the orientation of the receiver housing and connector housing can be obtained.

The receiver housing may comprise a front housing part and a rear housing part. In one embodiment, the receiver may be positioned in the rear housing part. The connector housing may comprise a plug part configured for attachment to the elongated tube and a plug base configured for attachment to a behind-the-ear part of a hearing aid.

In the context of the present invention, an "elongated tube" should be understood as a hollow tube having a length being considerably longer than the diameter of the tube, such as a length being at least 5 times larger than the largest dimension of the tube in a direction perpendicular to the longitudinal axis. The length of the tube may be in the range of 30-80 mm. The diameter of the tube may be in the range of 0.5-2 mm. The tube may be made from a plastic material, such as a polymer. In one embodiment, the provided elongated tube is straight.

The receiver may be adapted to receive an electrical signal and output a corresponding audio signal. As the signal to be transferred via the tube may be sound and/or an electric signal and/or an optical signal, the elongated tube may comprise at least one wire. The step of permanently deforming the tube may thus include bending of the at least one wire. The at least one wire may be attached to the inner wall of the tube to ensure that the wire is kept in place both during the manufacturing process and during use of the hearing air. Alternatively, the at least one wire may be moulded into the wall of the tube.

The behind-the-ear part may comprise electronics, controls, battery, microphone(s), and a receiver, if the receiver is not positioned in the receiver housing. However, an additional receiver may be positioned in the behind-the-ear part, if a receiver is positioned in the receiver housing. As an example, the additional receiver may be a bass receiver.

The behind-the-ear part and the connector housing may be provided with corresponding attachment elements to enable connection of the connector housing to the behind-the-ear part. As an example, these attachment elements may comprise plugs, corresponding inner and outer threading, snap-fit, or other similar attachment means allowing subsequently release of the behind-the-ear part. To enable electrical contact between the two elements, the connector housing may comprise connecting members, e.g. on the outside of the plug base, configured for contact with corresponding connecting members at the behind-the-ear part.

As an alternative, the behind-the-ear part and the connector may be permanently connected to each other after deformation of the tube. This may be achieved by gluing, welding, soldering, or other similar processes.

By positioning the electrical components outside the ear, the risk of moisture and earwax damaging the components can be considerably reduced, which may increase the durability of the hearing air.

The receiver housing may be made of a soft material, such as silicone, to improve comfort for the user. Alternatively, the receiver housing may be located in a shell made of a soft material, thereby improving the comfort. The receiver housing may be inserted in the shell after permanent deformation of the tube to ensure that the shell is not affected by the heating of the tube.

To improve comfort further, an individual shell may be made for each user to fit the ear of the user. Furthermore, the shell may be provided with a dome to improve comfort. Additionally, the behind-the-ear part may be arc-shaped to facilitate positioning of the hearing aid and the improve comfort.

The receiver housing and the connector housing may be attached to opposite ends of the elongated tube by different processes, such as gluing, welding, soldering, heat shrinking, etc. It should be understood, that the receiver housing may be attached by use of one process, whereas the connector housing may be attached using another process.

Traditionally, the tube has been heated by convection of hot air, e.g. by positioning the tube in an oven. To decrease time consumption associated with deformation of the tube, the step of permanently deforming the tube by exposing it to heat may be carried out by heat conduction.

In one embodiment, the step of exposing the tube to heat comprises a step of establishing contact between the tube and a heating surface to facilitate permanently deformation of the tube. The process temperature T1, i.e. the temperature to which the tube is heated, may vary, e.g. in dependency of the tube material, the tube material thickness, the size of the tube, etc.

To improve precision of the shape of the deformed tube, the step of establishing contact between the tube and the heating surface may comprise a step of arranging the tube in a fixture comprising the heating surface. The fixture may be configured to fix the tube in a deformed configuration which corresponds to the required shape of the tube of the receiver-in canal assembly.

The fixture may comprise a plate, e.g. made of metal, such as an alloy. The plate may be provided with a depression having a shape corresponding to the required shape of the tube in its final configuration. As an example, the elongated tube may manually be arranged in the depression by bending is by hand. When arranged in the depression, the fixture may fix the tube, and subsequently the permanent deformation may be carried out by exposing the tube to heat.

It should be understood that the arrangement of the tube in the fixture may alternatively be done automatically, e.g. by a robot, or a similar automatic process.

As the step of permanently deforming the tube may simultaneously be carried out for a plurality of receiver-in-canal assemblies, the fixture may be configured to fix a plurality of tubes, such as 2, 5, 7, 10, or even more tubes thereby facilitating simultaneous manufacturing of a number of receiver-in-canal assemblies. It should be understood, that a number of different fixtures may be applicable in order to provide assemblies of different size and/or shape e.g. depending on the user being a child or an adult. Consequently, the tubes may be deformed differently to fit different users.

The tube is permanently deformed after attachment of the receiver housing and the connector housing by exposing it to heat in a first predetermined treatment period t1. Due to the use of heat conduction, this first predetermined period of time t1 may be considerably smaller than the traditional heating period. In one embodiment, the first predetermined treatment period t1 is less than 6 minutes, such as less than 5 minutes.

To improve the deformation process of the tube, the step of permanently deforming the tube may comprise an additional step of cooling it for a second predetermined treatment period t2 after exposing it to heat. The second treatment period t2 may be less than 50 percent of the first treatment period t1. By cooling the deformed tube, the permanent deformation of the tube may be achieve more efficiently, thereby decreasing the time consumption associated with the deformation.

To facilitate cooling of the tube, the step of cooling the tube may comprise a step of establishing contact between the tube and a cooling surface as this may decrease the manufacturing time even further.

The step of establishing contact between the tube and the cooling surface may comprises a step of arranging the tube in a fixture comprising the cooling surface. The fixture may be configured to fix the tube in a deformed configuration.

It should be understood, that the fixture comprising the cooling surface may be the same fixture comprising the heating surface. Thus, the tube may initially be arranged in a deformation fixture which may comprise both a cooling surface and a heating surface, so that the permanently deformed tube is fixed in the fixture both during the first predetermined treatment period t1 and the second predetermined treatment period t2. This deformation fixture may be arranged in at least two different positions, a first position where contact is established between the tube and a heating surface and a second position where contact is established between the tube and a cooling surface.

This fixture may likewise be configured to fix a plurality of tubes, such as 2, 5, 7, 10, or even more tubes.

As an alternative, the fixture may be a separate element which may be arranged at two different locations, a first location where contact is established between the tube and a heating surface and a second location where contact is established between the tube and a cooling surface.

In a further alternative, the heating surface and the cooling surface may be one single element which may be configured to heat in a first configuration and may be configured to cool in a second configuration.

Due to the established contact between the tube and the cooling surface, the second predetermined treatment period t2 may be less than 3 minutes, such as less than 2 minutes.

The method may further comprise an intermediate treatment period tx between the first and second treatment period. The intermediate treatment period tx may be less than 10 percent of the first treatment period. During the intermediate treatment period tx, the at least one tube may be moved from the exposure to heat to the exposure to cold, or the heating/cooling surface may change from hot to cool.

In order to protect the receiver housing and the connector housing during the permanent deformation of the tube, the method may comprises a step of providing a thermal shield, and a step of arranging the thermal shield so that at least one of the receiver housing and the connector housing is not exposed to heat.

Shielding may alternative be provided by arranging at least one of the receiver housing and the connector housing so that it is not exposed to heat, e.g. by bending the tube in the area of the receiver housing so that contact between the receiver housing and the heating surface can be avoided.

According to a second aspect, the invention provides a receiver-in-canal assembly manufactured by the method according to the first aspect of the invention. It should be understood, that a skilled person would readily recognise that any feature described in combination with the first aspect of the invention could also be combined with the second aspect of the invention, and vice versa.

The method according to the first aspect of the invention is very suitable for manufacturing the assembly according to the second aspect of the invention. The remarks set forth above in relation to the method are therefore equally applicable in relation to the assembly.

BRIEF DESCRIPTION OF THE DRAWINGS

Embodiments of the invention will now be further described with reference to the drawings, in which.

DETAILED DESCRIPTION OF THE DRAWINGS

It should be understood that the detailed description and specific examples, while indicating embodiments of the invention, are given by way of illustration only, since various changes and modifications within the spirit and scope of the invention will become apparent to those skilled in the art from this detailed description.

Figure 1:
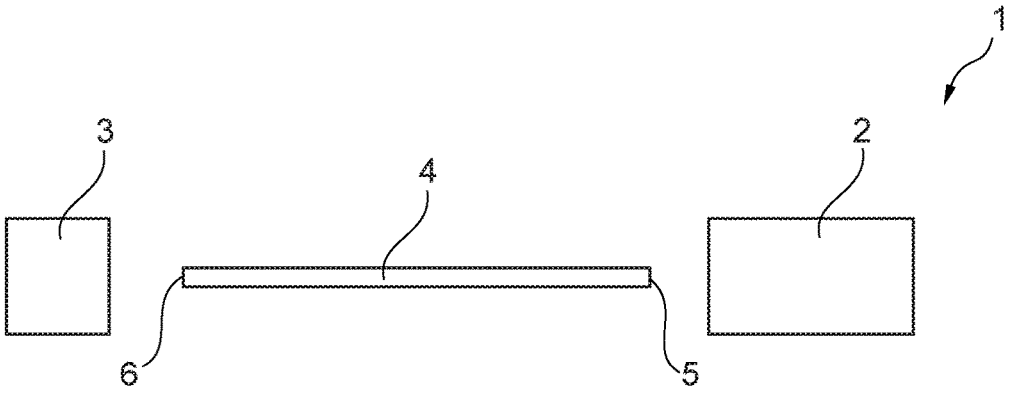
FIG. 1 schematically illustrates an un-assembled receiver-in-canal assembly comprising a receiver housing, a connector housing, and an elongated tube.

FIG. 1 schematically illustrates an un-assembled receiver-in-canal assembly 1 which comprises a receiver housing 2, a connector housing 3, and an elongated tube 4. The receiver housing 2 and the connector housing 3 are configured to be attached to opposite ends 5, 6 of the elongated tube 4.

Figure 2:
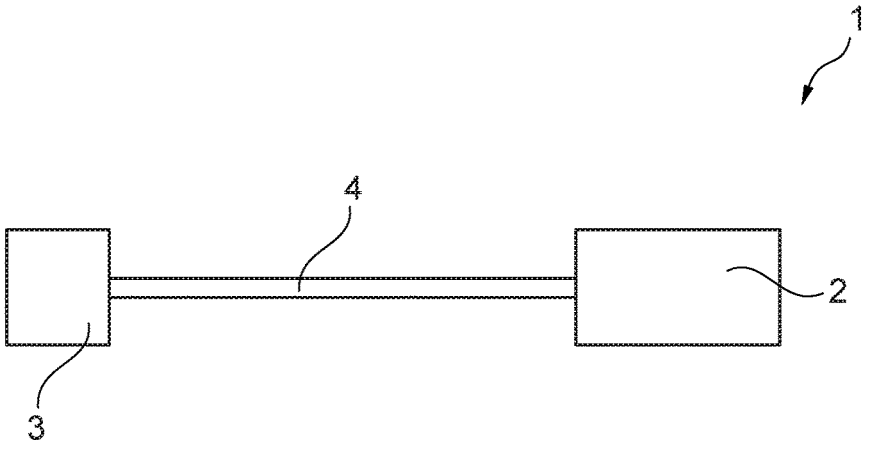
FIG. 2 schematically illustrates an assembled receiver-in-canal assembly before permanent deformation of the elongated tube.

FIGS. 1 and 2 are for illustration of the different features only, and it should be understood that the features are not correctly scaled relative to each other.

The receiver housing 2 is configured to be positioned in or at the ear canal of a user, and is further configured to comprise a receiver (not shown), which receiver is configured to output sound. The connector housing 3 is configured to be connected to a behind-the-ear part (not shown) of a hearing aid. The behind-the-ear part is configured to generate the sound signal which may be transferred to the receiver housing 2 and the receiver via the elongated tube 4.

FIG. 2 schematically illustrates a receiver-in-canal assembly 1 where the receiver housing 2 and the connector housing 3 have been attached to opposite ends 5, 6 of the elongated tube 4.

Figure 3:
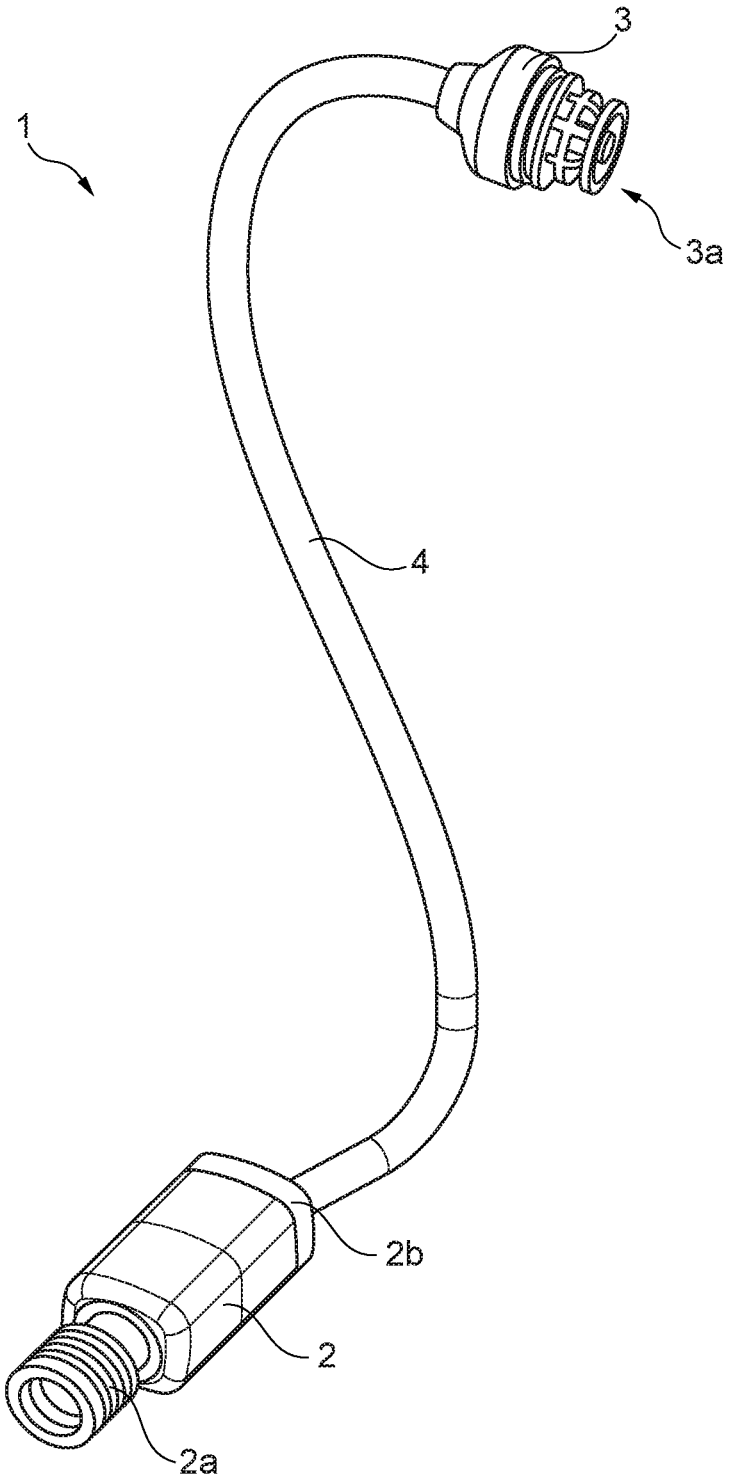
FIG. 3 illustrates a receiver-in-canal assembly after permanent deformation of the elongated tube.

FIG. 3 illustrates the receiver-in-canal assembly 1 after permanent deformation of the elongated tube 4. The receiver housing 2 comprises a front housing part 2*a* and a rear housing part 2*b*. In the illustrated embodiment, the receiver (not shown) is positioned in the rear housing part 2*b*.

The connector housing 3 is configured to be connected to a behind-the-ear part (nor shown) of a hearing aid via the plug base 3*a*.

Figure 4:
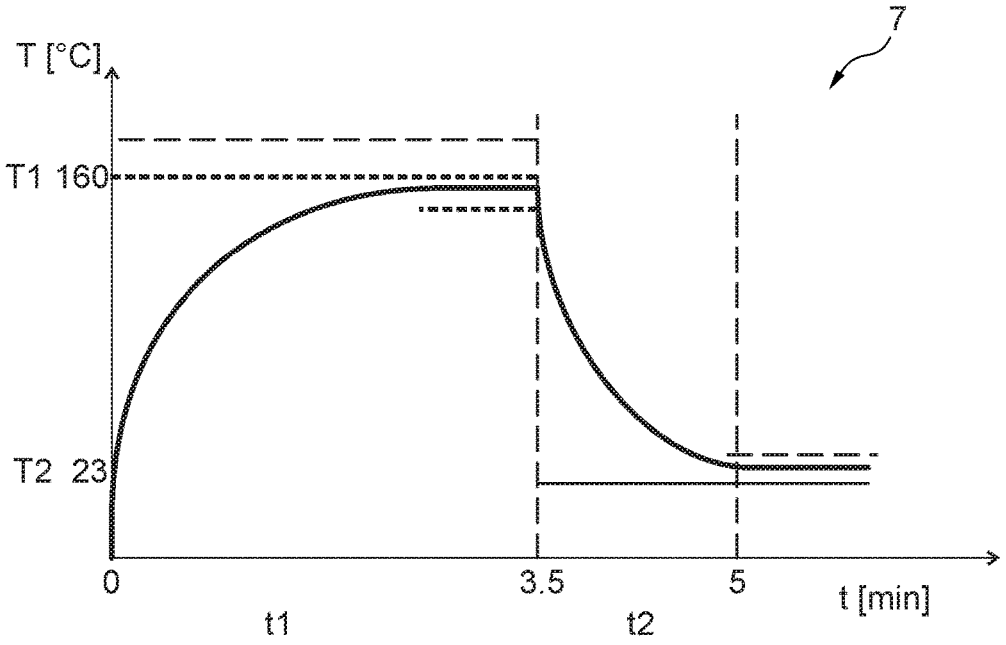
FIG. 4 illustrates a curve for the treatment temperature T in dependency of time t.

FIG. 4 illustrates a curve 7 for the treatment temperature T [degrees Celsius] in dependency of time t [minutes]. In the illustrated embodiment, the elongated tube 4 is heated to a process temperature T1 of 160 degrees Celsius+/−2 degrees Celsius during a first treatment period t1 till this temperature is reached. The first treatment period t1 is in this embodiment 3.5 minutes. The maximum temperature, being the process temperature T1 is maintained during an additional treatment period of 30 seconds. The additional treatment period starts from the moment when the first treatment period t1 is completed. The additional treatment period does not appear from FIG. 4.

The additional treatment period depends on the material properties of the tubes 4 and more specifically on the relaxation properties. Relaxation should be understood as the process of a material, such as polymers, undergoing a change of internal structure under constant stress. The additional treatment period may be less than 1 minutes, such as about 30 seconds.

Subsequently, the elongated tube 4 is cooled down to about room temperature T2 during a second treatment period t2. In the illustrated embodiment the second treatment period t2 is 1.5 minutes. This second treatment period t2 may however be shorter, such as approximately 1 minute, or even shorter, such as about 30 seconds.

Heating during the first treatment period t1 is carried out by positioning the elongated tube 4 on a heating surface 8 (see FIG. 6) so that it can be heated by conduction. The subsequent cooling of the tube 4 during the second treatment period t2 is carried out by positioning the tube on a cooling surface (not shown) during the second treatment period t2.

The cooling of the tube 4 need not reach room temperature T2 by aid of the cooling surface, as the final cooling may take place after interruption of contact between the tube(s) and the cooling surface. Consequently, the tube(s) may be cooled to a temperature in the range of e.g. 20-40 degrees Celsius by aid of the cooling surface.

The deformation process for the elongated tube further comprises a step of moving the tube from the heating surface to the cooling surface. This intermediate step is performed during an intermediate treatment period tx between the first and second treatment periods t1, t2. Typically, this intermediate treatment period tx has a duration of approximately less than 30 seconds.

Figure 5:
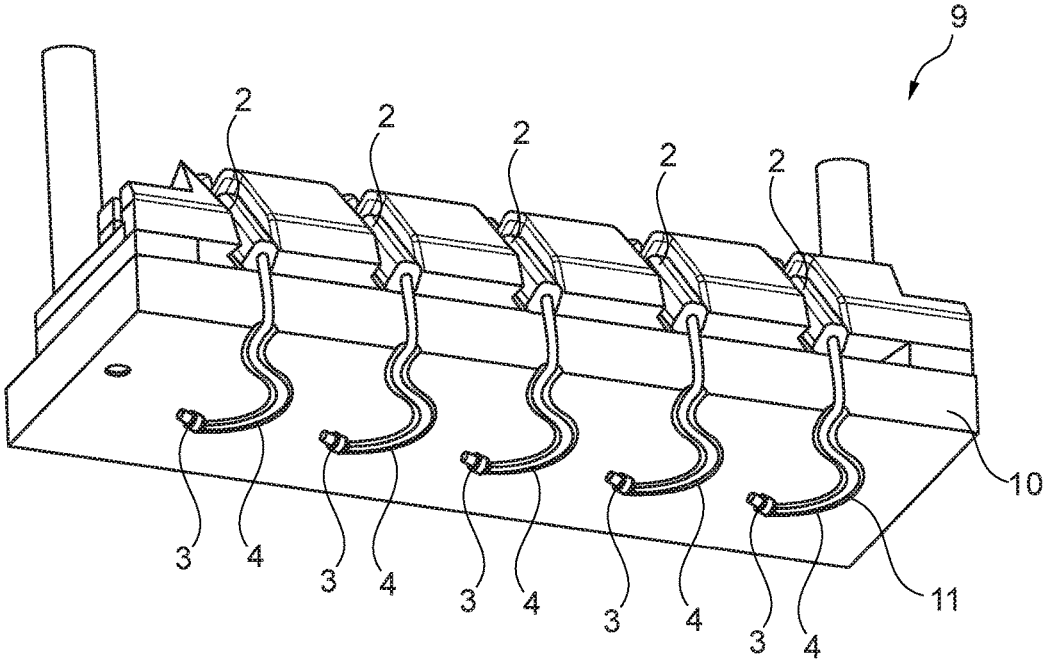
FIG. 5 illustrates a fixture configured to fix the tube in a deformed configuration.

FIG. 5 illustrates a fixture 9 configured to fix five tubes 4 in a deformed configuration after attachment of the receiver housing 2 and the connector housing 3. The fixture 9 comprises a plate 10 made of an alloy. The plate 10 is provided with five depressions 11 each having a shape corresponding to the required shape of the tubes 4 in their final configuration. When arranged in the depressions 11, the fixture 9 fixes the tubes 4. Subsequently the permanent deformation can be achieved by exposing the tubes 4 to heat.

Figure 6:
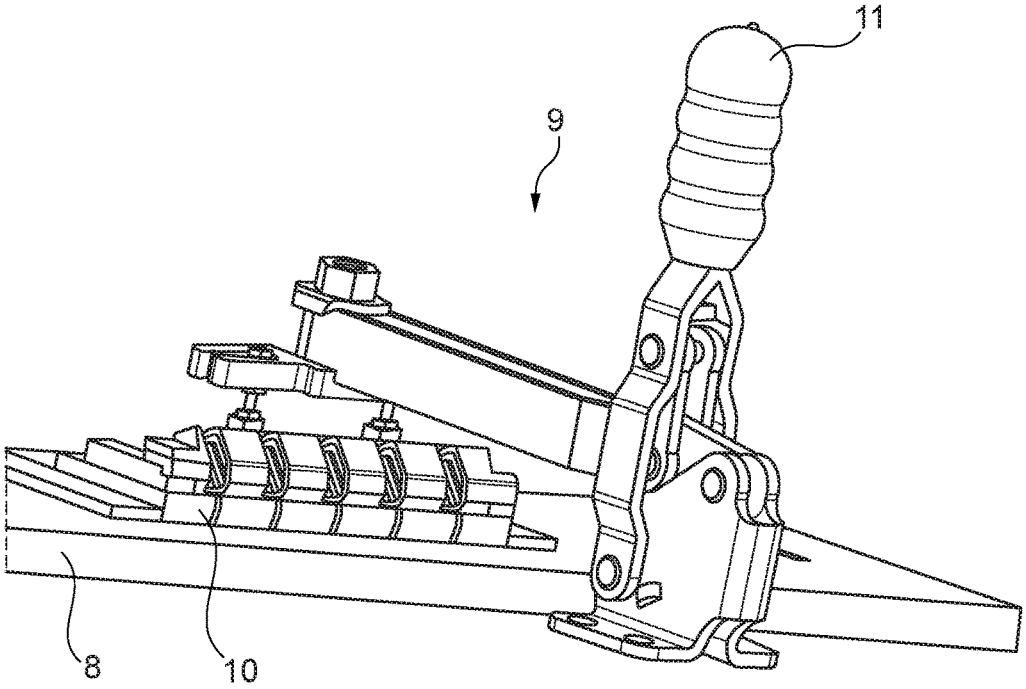
FIG. 6 illustrates a fixture applied in a step of establishing contact between the tube and a heating surface.

FIG. 6 illustrates the tubes (not visible) being exposed to heat by establishing contact between the tubes and the heating surface 8. The tubes 4 are placed in a deformed configuration in the fixture 9, and subsequently the fixture 9 is placed on the heating surface 8 which heats. The fixture 9 is operated by use of the handle 11. When the handle 11 is moved, the plate 10 with the tubes 4 can be moved up and down to establish and interrupt contact between the tubes 4 and the heating surface 8.

Due to temperature gradients present in the plate 10 and to ensure that the deformed tubes 4 present in the fixture 9 reaches the desired temperature, the plate 10 is maintained on the heating surface 8 for an additional treatment period.

The invention claimed is:

1. A method of manufacturing one or more receiver-in-canal assemblies, the method comprising steps of:

providing a receiver housing configured to be positioned in or at the ear canal of a user, said receiver housing including a receiver to output sound;

providing a connector housing configured to be connected to a behind-the-ear part of a hearing aid;

providing an elongated tube configured for transfer of a signal from the connector housing to the receiver housing;

attaching the receiver housing and the connector housing to opposite ends of the elongated tube, thereby forming the one or more receiver-in-canal assemblies; and permanently deforming the elongated tube after attachment of the receiver housing and the connector housing to the elongated tube by exposing the elongated tube to heat in a first predetermined treatment period t1.

2. The method according to claim 1, wherein the elongated tube is straight prior to carrying out the step of permanently deforming.

3. The method according to claim 2, wherein the elongated tube comprises at least one wire, and wherein the step of permanently deforming the elongated tube comprises bending of the at least one wire.

4. The method according to claim 2, wherein the step of permanently deforming the elongated tube comprises a step of cooling the elongated tube for a second predetermined treatment period t2 after exposing the elongated tube to heat, the second treatment period t2 being less than 50 percent of the first treatment period t1.

5. The method according to claim 2, further comprising a step of providing a thermal shield, and a step of arranging the thermal shield so that at least one of the receiver housing and the connector housing is not exposed to heat.

6. The method according to claim 2, wherein the step of permanently deforming the elongated tube is simultaneously carried out for a plurality of receiver-in-canal assemblies.

7. The method according to claim 1, wherein the elongated tube comprises at least one wire inside the tube extending between the receiver and the connector housing, and wherein the step of permanently deforming the elongated tube comprises bending of the at least one wire, the method further comprising fixing the wire relative to an inner wall of the tube.

8. The method according to claim 7, wherein the step of permanently deforming the elongated tube comprises a step of cooling the elongated tube for a second predetermined treatment period t2 after exposing the elongated tube to heat, the second treatment period t2 being less than 50 percent of the first treatment period t1.

9. The method according to claim 7, wherein the step of permanently deforming the elongated tube by exposing the elongated tube to heat is carried out by heat conduction, and wherein the step of exposing the elongated tube to heat comprises a step of establishing contact between the elongated tube and a heating surface.

10. The method according to claim 1, wherein the step of permanently deforming the elongated tube by exposing the elongated tube to heat is carried out by heat conduction.

11. The method according to claim 10, wherein the step of exposing the elongated tube to heat comprises a step of establishing contact between the elongated tube and a heating surface.

12. The method according to claim 11, wherein the step of establishing contact comprises a step of arranging the elongated tube in a fixture comprising the heating surface, the fixture being configured to fix the elongated tube in a deformed configuration.

13. The method according to claim 12, wherein the elongated tube is arranged in a depression in the fixture while being exposed to the heat.

14. The method according to claim 1, wherein the first predetermined treatment t1 period is less than 6 minutes.

15. The method according to claim 1, wherein the step of permanently deforming the elongated tube comprises a step of cooling the elongated tube for a second predetermined treatment period t2 after exposing the elongated tube to heat, the second treatment period t2 being less than 50 percent of the first treatment period t1.

16. The method according to claim 15, wherein the step of cooling the elongated tube comprises a step of establishing contact between the elongated tube and a cooling surface.

17. The method according to claim 16, wherein the step of establishing contact comprises a step of arranging the elongated tube in a fixture comprising the cooling surface, the fixture being configured to fix the elongated tube in a deformed configuration.

18. The method according to claim 16, further comprising an intermediate treatment period tx between the first and second treatment period t1, t2, the intermediate treatment period tx being less than 10 percent of the first treatment period t1.

19. The method according to claim 15, wherein the second predetermined treatment period t2 is less than 3 minutes.

20. The method according to claim 15, further comprising an intermediate treatment period tx between the first and second treatment period t1, t2, the intermediate treatment period tx being less than 10 percent of the first treatment period t1.

21. The method according to claim 1, further comprising a step of providing a thermal shield, and a step of arranging the thermal shield so that at least one of the receiver housing and the connector housing is not exposed to heat.

22. The method according to claim 1, wherein the step of permanently deforming the elongated tube is simultaneously carried out for a plurality of receiver-in-canal assemblies.

23. The method according to claim 1, wherein the receiver housing includes a front housing part and a rear housing part, and wherein the receiver is positioned in the rear housing part.

24. The method according to claim 1, wherein the first predetermined treatment period t1 is in a range from 3.5 minutes to 6 minutes.

25. The method according to claim 1, wherein the step of permanently deforming the elongated tube comprises a step of cooling the elongated tube for a second predetermined treatment period t2 after exposing the elongated tube to heat, wherein the second predetermined treatment period t2 is in a range from 30 seconds to 3 minutes.

26. A method of manufacturing a receiver-in-canal assembly, comprising steps of:

providing a receiver housing configured to be positioned in or at the ear canal of a user, the receiver housing including a receiver to output sound;

providing a connector housing configured to be connected to a behind-the-ear part of a hearing aid;

providing an elongated tube configured for transfer of a signal from the connector housing to the receiver housing;

attaching the receiver housing and the connector housing to opposite ends of the elongated tube, thereby forming the receiver-in-canal assembly; and permanently deforming the elongated tube after attachment of the receiver housing and the connector housing to the elongated tube by exposing at least a portion of the elongated tube to heat by way of heat conduction in a first predetermined treatment period and then by cooling the elongated tube for a second predetermined treatment period that is less than 50 percent of the first predetermined treatment period.

* * * * *